US006561919B2

(12) United States Patent
Edel

(10) Patent No.: US 6,561,919 B2
(45) Date of Patent: May 13, 2003

(54) GOLF CLUB

(76) Inventor: David Edel, 1400 Highway Ave. 101, Reedsport, OR (US) 97467

( * ) Notice: Subject to any disclaimer, the term of this patent is extended or adjusted under 35 U.S.C. 154(b) by 0 days.

(21) Appl. No.: 10/052,090

(22) Filed: Jan. 17, 2002

(65) Prior Publication Data

US 2002/0193174 A1 Dec. 19, 2002

Related U.S. Application Data

(60) Provisional application No. 60/299,548, filed on Jun. 18, 2001.

(51) Int. Cl.[7] ..... A63B 53/02

(52) U.S. Cl. ..... 473/250; 473/312; 473/313

(58) Field of Search ..... 473/312, 313, 473/340, 341, 250

(56) References Cited

U.S. PATENT DOCUMENTS

| | | | | |
|---|---|---|---|---|
| 2,121,295 | A | | 6/1938 | Jennings |
| 3,866,922 | A | | 2/1975 | Marci et al. |
| 3,992,015 | A | | 11/1976 | Benson |
| 4,212,467 | A | | 7/1980 | Shiratori |
| 4,327,916 | A | | 5/1982 | Shiratori |
| 4,423,873 | A | | 1/1984 | Shiratori |
| 4,832,340 | A | * | 5/1989 | Pickering |
| 4,913,437 | A | | 4/1990 | Newcomb et al. |
| 5,467,989 | A | | 11/1995 | Good et al. |
| 5,505,447 | A | | 4/1996 | Mockovak |
| 5,647,807 | A | | 7/1997 | Nagamoto |
| 5,913,733 | A | * | 6/1999 | Bamber |
| 5,980,394 | A | | 11/1999 | Domas |
| 6,050,903 | A | * | 4/2000 | Lake |
| 6,231,455 | B1 | | 5/2001 | Chang |

FOREIGN PATENT DOCUMENTS

| | | |
|---|---|---|
| CH | 5581 83 | 1/1975 |
| GB | 371974 | 5/1932 |

* cited by examiner

*Primary Examiner*—Stephen Blau
(74) *Attorney, Agent, or Firm*—Kolisch Hartwell, P.C.

(57) ABSTRACT

A golf club having a transparent hosel is provided. The ends of the hosel may further include connecting portions adapted to receive the connecting portions of a shaft and clubhead. The connecting portions may include an inner post and an outer sheath adapted to form an interference fit with the connecting portions of the shaft or clubhead.

15 Claims, 4 Drawing Sheets

GOLF CLUB

CROSS REFERENCE TO RELATED APPLICATIONS

The present application claims priority from Provisional Patent application Ser. No. 60/299,548, filed Jun. 18, 2001, which is hereby incorporated by reference in its entirety for all purposes.

BACKGROUND OF THE INVENTION

A golf club typically includes four distinctive elements, a grip, a shaft, a hosel, and a head. The grip is typically applied to the shaft and provides an area for the user (or golfer) to hold the golf club. The shaft is an elongated element typically made of steel or graphite, though it may be made of another material or a combination of several materials. The length of the shaft may vary depending upon the height and desire of the user and the type of golf club. The hosel is the connective stem between the shaft and the head. The head provides a surface with which the golfer may strike a ball. The combination of the shape of head and the angle of striking surface, along with the type of golf swing executed by the golfer, determine both the trajectory and distance the ball will travel after it is struck by the golf club.

A putter is a type of golf club that is generally used to roll the ball (or putt) along the surface of a golf course. Golfers typically putt the ball when they are trying to roll the ball into the hole from on or near the green. Because the hole has a relatively small diameter compared to the playing surface, putting accurately is vital to a successful golf game. Proper alignment of the putter with the golf ball and the intended path of the ball are crucial elements of an accurate putt.

A golfer typically tries to cause a golf ball to roll in a trajectory on the green so that the golf ball will fall into the hole. This trajectory is typically called "the line." The golfer tries to get the ball to roll on the line and is said to "line-up" the putt before causing the golf ball to roll towards the hole. Putters may have markings or be designed to assist the golfer in lining-up a putt to make it easier for the golfer to roll the ball on the line.

Many novice, and some expert, golfers find that the hosel interferes with their ability to putt accurately. As an example, when a golfer assumes the standard putting position, the putter's line of sight to the ball and putter head surface is typically interrupted by the hosel. Due to the optics of binocular vision, a viewer's eyes tend to naturally focus on the object that is closest (i.e. the hosel) and blur objects that are further away, particularly when they are directly behind the closer object (i.e. the putter head and ball). Mental focus is typically required to force the viewer's eyes to focus on the objects that are behind the closer object. The visual interference and requirement for mental focus created by the visual impact of the hosel may cause the golfer to lose concentration and putt inaccurately.

In addition, the "feel" of the golf club can vary greatly depending on the material used for both the shaft and the head of the club, the degree of flex in the shaft, and the types of connections used between the various elements of the club. Golfers tend to seek those clubs that have the best feel for their style of play.

SUMMARY OF THE INVENTION

In one embodiment, the present invention provides a golf club. The golf club includes a shaft, a head, and a transparent hosel connecting the shaft to the head. The transparent hosel is configured to engage the shaft in an interference fit.

In another embodiment, the present invention provides a golf club hosel having a shaft-connecting portion. The shaft-connecting portion includes an inner post and an outer sleeve.

In yet another embodiment, the present invention provides a putter comprising a head, a shaft including a grip, and a transparent hosel connecting the shaft to the head.

DETAILED DESCRIPTION OF THE INVENTION

The present invention provides a hosel that does not interfere with the golfer's line of sight, particularly when aligning the head of a club with a golf ball, thereby assisting the golfer in aligning the putt correctly. In one embodiment, the invention provides a golf club having a transparent hosel, or neck. The transparent hosel is suitable for any type of golf club including drivers, driving irons, fairway woods, irons, wedges, chippers, putters, and the like.

Figure 1:
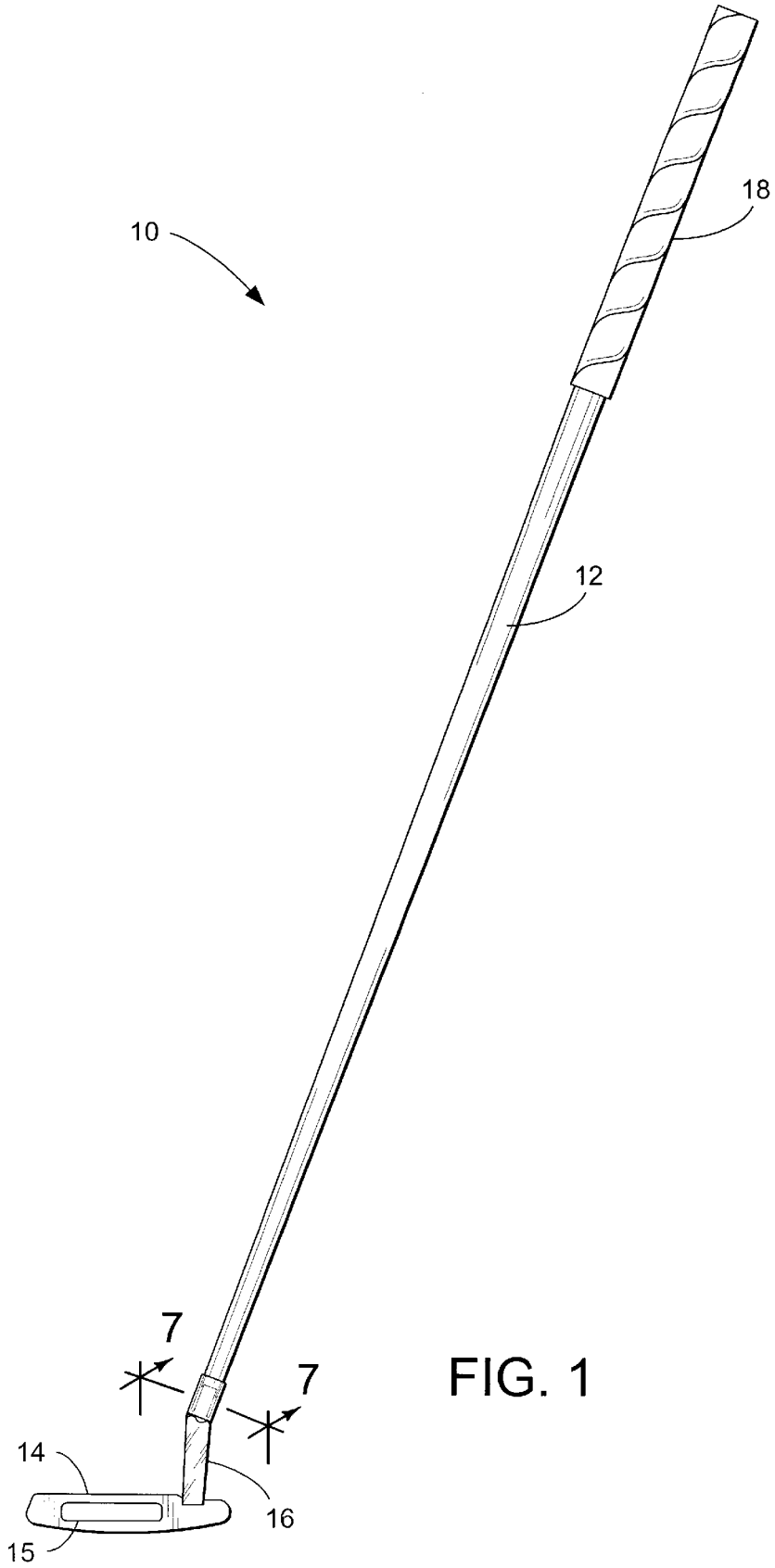
FIG. 1 is a schematic illustration of a golf club including a hosel according to one embodiment of the present invention.

As shown in FIG. 1, a golf club 10 includes a shaft 12 connected to head 14, by a transparent hosel, or neck, 16. Shaft 12 may additionally include a grip 18. Shaft 12 may be cylindrical or other shape and may also be partially hollow. Transparent hosel 16 connects to both shaft 12 and head 14. Club head 14 typically includes a striking surface (or club face) 15, which is used to strike the ball. The club head and striking surface may be made of the same or different material.

While only one style of hosel is shown in FIGS. 1–7, it should be appreciated that hosel 16 may take a variety of shapes including traditional hosel shapes such as L-shaped or Anser style, slant neck, and S-bend. Hosel 16 may be made of any suitable clear or transparent material including clear plastic such as polycarbonate or the like. A transparent hosel produces little to no interference in the golfer's line of sight to the striking surface of the golf club.

For example, hosel 16 may aid a golfer in obtaining an accurate putting stroke by eliminating the distraction created by the presence of an opaque hosel. In some cases, golfers may use the markings on the putter and striking surface to align the putter with the intended path to the hole. In other cases, golfers prefer to align the striking surface with the ball without the use of markings on the putter. Regardless, the golfer's ability to accurately align the putter with the ball may be diminished by the presence of an opaque hosel that interrupt the direct path between the golfer's eye and the putter's striking surface. A transparent hosel may reduce the distraction created by the hosel and allows the golfer to accurately align the striking surface with the ball.

Figure 2:
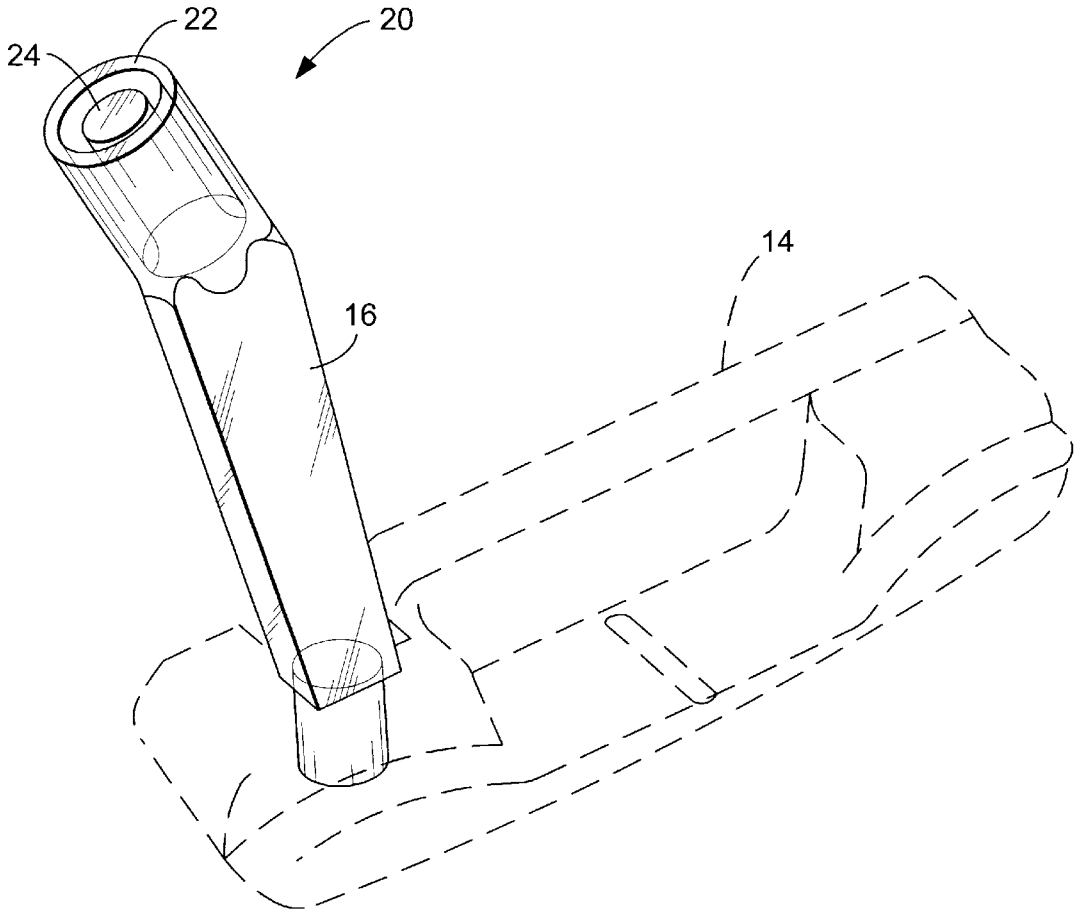
FIG. 2 is a schematic illustration of a transparent hosel of the present invention connected to a putter head.

In FIG. 2, hosel 16 is shown at a larger scale. Again, hosel 16 is connected to head 14. In this depiction, head 14 is a putter head. However, it should be appreciated that head 14 could be a driver, driving iron, fairway wood, iron, wedge, chipper or any other type of golf club head.

In addition to correct alignment of the club head with the ball, golfers often desire a greater amount of feel with their golf clubs, and in particular with respect to their putters. The correct feel differs for each individual golfer. For example a correct feel for a particular golfer may mean that the shaft and hosel provide more or less stiffness or more or less feedback as the clubhead strikes the ball. The hosel of the present invention may be adapted to adjust the feel of the club to the specific taste of the golfer. For example, because the transparent hosel is typically formed of a clear plastic, the hosel will typically provide a slight amount of flex. Furthermore, different plastics of different hardness may be used to make the hosel softer or harder or provide more or less flex to the hosel. Because traditional hosels have been made of metal, it has not been possible to provide a flexible hosel, let alone a hosel in which the amount of flex can be adjusted by varying the material composition of the hosel.

The present invention further provides a post and sleeve configuration for connecting various parts of a golf club. The post and sleeve configuration increases the strength of the connection and creates a better feel for the golfer. In one embodiment, the present invention provides a putter with a clear or transparent hosel and a post and sleeve configuration for connecting the hosel to the shaft of a golf club.

Thus, as shown in FIG. 2, hosel 16 may have a shaft-connecting portion 20 that is configured to form an interference fit with shaft 12. In this embodiment, shaft-connecting portion 20 has an outer sleeve 22 and an inner post 24 that are configured to form an interference fit with the golf club shaft (not shown).

Figure 7:
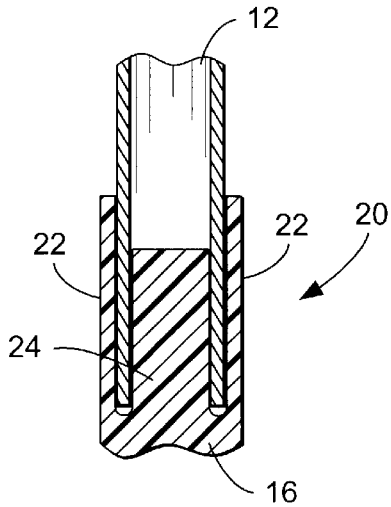
FIG. 7 is a schematic illustration of a cross-section of a hosel shaft-connecting portion of the present invention.

A close-up of the interference fit between hosel 16 and shaft 12 is shown in FIG. 7, which shows a vertical cross-section of shaft-connecting portion 20 with shaft 12 inserted between outer sleeve 22 and inner post 24. Typically, inner post 24 fits into the partially hollow shaft 12 while outer sleeve 22 surrounds a portion of shaft 12, thereby forming an interference fit between the ends of hosel 16 and shaft 12.

The interference fit between hosel 16 and shaft 12 may provide a better feel for the golfer using golf club 10, as the post and sleeve configuration connection may be more stable, secure, and durable than previous connections, which typically have either a post or a sleeve, but not both. As will be appreciated, as an alternative embodiment, the end of shaft 12 may terminate in an inner post and outer sleeve and hosel 16 may terminate in a hollow or partially hollow cylinder adapted to form an interference fit with the post and sleeve end of shaft 12.

As will be appreciated shaft 12 may be secured to hosel 16 by any suitable means including an adhesive (not shown). Because golf clubs may be exposed to a variety of weather elements, it may be desirable for the adhesive to be waterproof and able to withstand normal external temperature ranges.

Figure 3:
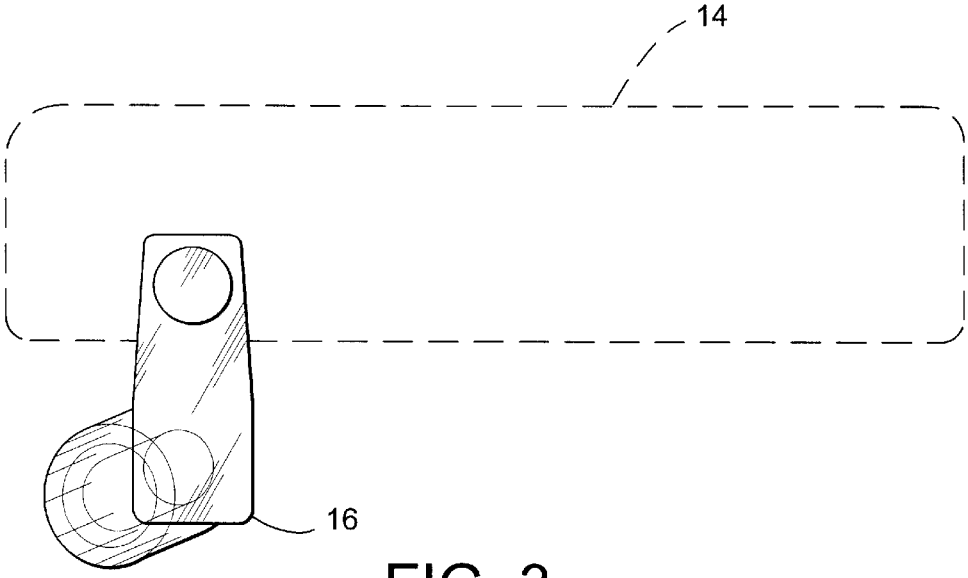
FIG. 3 is a bottom-view of the hosel of FIG. 2.
Figure 4:
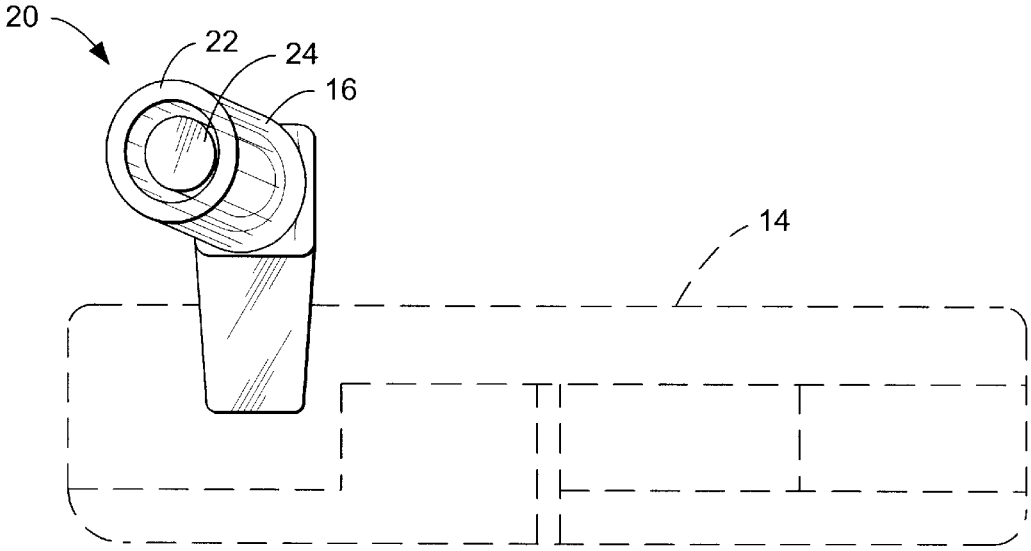
FIG. 4 is a top-view of the hosel of FIG. 2.
Figure 5:
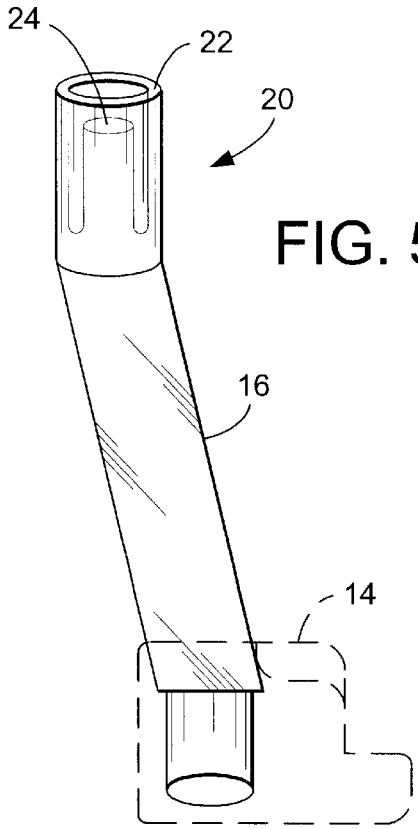
FIG. 5 is a rear-view of the hosel of FIG. 2.
Figure 6:
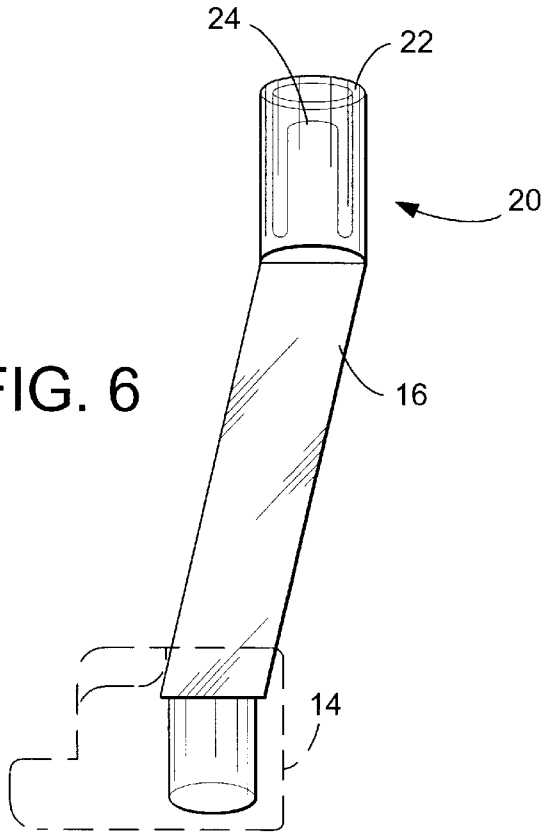
FIG. 6 is a front-view of the hosel of FIG. 2

FIG. 3 shows a bottom view of hosel 16 and head 14. FIG. 4 shows a top view of hosel 16 and head 14. FIGS. 5 and 6 show rear and front views of hosel 16 and head 14, respectively. In all figures, shaft-connecting portion 20 is shown, as well as outer sleeve 22 and inner post 24.

While the present invention has been described primarily with respect to a putter, the hosel of the present invention is useful for any golf club including drivers, fairway woods, irons, wedges, chippers, and the like. Furthermore, while the present invention has been primarily illustrated as being a transparent hosel having a inner post and outer sleeve assembly adapted to receive a shaft, it should be appreciated that the inner post and outer sleeve assembly could be used with an opaque hosel made of traditional metal or wood materials and that the transparent hosel could be used with a traditional shaft-connecting portion including either a post or a sleeve and that such embodiments are contemplated by the scope of the present invention.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

Inventions embodied in various combinations and subcombinations of features, functions, elements and/or properties may be claimed in this or a related application. Such claims, whether they are directed to a different invention or directed to the same invention, whether different, broader, narrower or equal in scope to any original claims, are also regarded as included within the subject matter of the inventions of the present disclosure.

What is claimed is:

1. A golf club comprising:

a shaft;

a head; and a transparent connecting piece situated between the shaft and the head wherein the head and connecting piece are made from different materials.

2. The golf club of claim 1 wherein at least a portion of the transparent connecting piece is plastic.

3. The golf club of claim 1 wherein the golf club is a putter.

4. The golf club of claim 1 wherein the connecting piece is slant neck shaped.

5. The golf club of claim 1 wherein the connecting piece provides flex.

6. The golf club of claim 1 wherein the connecting piece is configured to form an interference fit with the shaft.

7. The golf club of claim 1 wherein the connecting piece is configured to form an interference fit with the head.

8. The golf club of claim 1 wherein the head includes an opaque striking surface.

9. The golf club of claim 1 wherein the head is opaque.

10. A golf club comprising;

a head having an opaque striking surface;

a shaft including a grip; and a transparent connecting piece situated between the shaft and the head.

11. The golf club of claim 10 wherein the connecting piece is configured to form an interference fit with the shaft.

12. The golf club of claim 10 wherein an end of the connecting piece includes an inner post and an outer sleeve.

13. The golf club of claim 10 wherein the connecting piece is flexible.

14. The golf club of claim 10 wherein the connecting piece is slant neck shaped.

15. The golf club of claim 10 wherein the head is opaque.

* * * * *